US007967925B2

(12) United States Patent
Wang

(10) Patent No.: US 7,967,925 B2
(45) Date of Patent: Jun. 28, 2011

(54) ACCELERATED SOLUTION TREATMENT PROCESS FOR ALUMINUM ALLOYS

(75) Inventor: Qigui Wang, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 100 days.

(21) Appl. No.: 12/145,614

(22) Filed: Jun. 25, 2008

(65) Prior Publication Data

US 2009/0320963 A1 Dec. 31, 2009

(51) Int. Cl.
*C22F 1/04* (2006.01)

(52) U.S. Cl. ..... 148/502; 148/698

(58) Field of Classification Search ..... 148/698, 148/502

See application file for complete search history.

(56) References Cited

U.S. PATENT DOCUMENTS 6,269,321 B1 7/2001 Palle et al.
6,858,103 B2 * 2/2005 Wolverton et al. ..... 148/502

OTHER PUBLICATIONS

"Aluminum and Aluminum Alloys", ASM International, 1993, p. 290-299.*

Sigli, C. "Nucleation, Growth and Coarsening of Spherical Precipitates in Aluminum Alloys". ICAA&, 7th International Conference on Aluminum Alloys, Apr. 2000.*

Li, G. et al; Homogenizing treatment of 7B50 high strength aluminum alloy; The Chinese Journal of Nonferrous Metals; May 2008; pp. 764-770; vol. 18, No. 5.

Davis, J.R. et al.; Aluminum and Aluminum Alloys; ASM Specialty Handbook; 1993; pp. 285-299 ASM International.

Sigli, C.; Nucleation, Growth and Coarsening of Spherical Precipitates in Aluminum Alloys; 7th International Conference on Aluminum Alloys; Apr. 2000.

* cited by examiner

*Primary Examiner* — Roy King
*Assistant Examiner* — Janelle Morillo
(74) *Attorney, Agent, or Firm* — Dinsmore & Shohl LLP

(57) ABSTRACT

A method of providing solution heat treatment to an aluminum alloy. A non-isothermal process is used to provide a faster heat treatment cycle time while maintaining or further improving the alloy mechanical properties after subsequent aging hardening. The process includes establishing a temperature inside a processing vessel that is greater than a soaking temperature but less than a liquidus temperature of the alloy, rapidly heating the alloy to the soaking temperature in a first heating operation, reducing the temperature inside of the processing vessel to the soaking temperature, then heating the alloy to a temperature above the soaking temperature through a gradually increasing temperature in a second heating operation. Protocols for the improved solution heat treatment may be based on one or more of computational thermodynamics, dissolution kinetics and coarsening kinetics.

17 Claims, 8 Drawing Sheets

ACCELERATED SOLUTION TREATMENT PROCESS FOR ALUMINUM ALLOYS

BACKGROUND OF THE INVENTION

The present invention relates generally to ways to increase mechanical properties of aluminum alloys, including cast aluminum alloys and components made therefrom, through optimization of solution heat treatment, and more particularly to optimizing a non-isothermal solution treatment based on principles of physical metallurgy and computational thermodynamics and kinetics to achieve target material properties with minimum energy consumption and lead or cycle time.

Aluminum alloys in general, and aluminum-silicon based (Al—Si) alloys in particular (examples of which include A356, 319 and A357) are well known in the automotive and related transportation industries for their strength, ductility and ability to be cast at a relatively low cost. Strengthening by age (also known as precipitation) hardening is applicable to alloys in which the solid solubility of at least one alloying element decreases with deceasing temperature, and solution heat treatment is one way to achieve the desired strength of cast aluminum alloys through precipitation hardening. Examples of wrought and cast aluminum alloys where solution heat treatment can be used to increase age-hardenability include those of the 6000, 7000 and 300 series.

Solution heat treatment serves three main purposes: (1) the dissolution of solute elements from the intermetallic phases that will later cause age hardening, (2) the spheroidization of undissolved constituents, and (3) the homogenization of solute concentrations in the material after casting to achieve a desired strength value. In the traditional solution treatment (either batch or continuous processing in hot-air furnace or fluidized bed), the solution treatment cycle is usually a single step process in which the casting is heated up to a specific temperature and then held at the temperature for a specified time.

As will be appreciated by those skilled in the art, there are many methods for applying solution heat treatments to aluminum alloys. One method is to place the materials in a hot-air furnace. Another method uses a fluidized-bed furnace, where the furnace or fluidizing medium is heated from room temperature directly to soaking temperature and then keep at the soaking temperature for the entire solution heat treatment. There are problems with both of these forms of conventional solution treatment processes. Regarding hot-air furnaces, the heat-treating processes take a long time (for example, from 6 to 10 hrs) at a relatively low and constant temperature. Under these conditions, not only more energy is consumed but also the low melting-point equilibrium phases in the aluminum alloys are dissolved slowly due to the low diffusion kinetics. Such slow diffusion is incompatible with efficient, high-speed manufacture of aluminum alloys and parts, components and related devices made therefrom. In addition, the low solubility of solute elements, due to low soaking temperature in the conventional solution treatment limits the potential of subsequent age hardening. As a result, the materials properties, in particular the tensile strengths are usually low.

Regarding the fluidized bed furnace, a fluidized medium is used that is physically similar to an inert liquid, which in turn means that heat transfer to an article is relatively rapid. In either the hot-air furnace or fluidized bed approach, the furnace or fluidizing medium is heated from room temperature directly to soaking temperature and then kept at the soaking temperature for the entire solution heat treatment, as shown in FIGS. 1A for a batch process and FIG. 1B for a continuous process. In a batch type furnace, the furnace starts heating up after the parts are loaded and furnace door is closed. The parts are also stationary in the furnace. By contrast, in the continuous furnace, the parts are loaded from one end and unloaded from other end of the furnace. The parts are also moving slowly inside the furnace. In either case, the soaking takes a long time, consuming significant amounts of energy in the process. Generally, the continuous processing is better for mass production in comparison with batch processing. Likewise, the prolonged solution heat treatment coarsens eutectic particles (for example, silicon), resulting in silicon depletion at the periphery of the dendrites.

Solution heat treatment is one component of a larger strategy for the heat treatment of age-hardenable aluminum alloys normally. In addition to the aforementioned solution treatment of the products or components at a relatively high temperature (but below the melting temperature of the alloy), two additional steps are typically performed. First, rapid cooling (or quenching) in a cold media, such as water, is carried out at a designed temperature (such as room-temperature). Then the product or component is aged by holding them for a period of time at room temperature (also called natural aging) or at an intermediate temperature (known as artificial aging). The quenching action tends to retain the solute elements in a supersaturated solid solution and also to create a supersaturation of vacancies that enhance the diffusion and the dispersion of precipitates. To maximize strength of the alloy, the precipitation of all strengthening phases should be prevented during quenching. Aging (either natural or artificial) creates a controlled dispersion of strengthening precipitates.

One well-known way to heat treat aluminum alloy castings is the T-6 process. As shown in FIG. 2, T-6 generally involves holding the cast part at high temperatures for extended periods of time (typically 12 or more hours), followed by a water quench and extended aging (often called natural aging, and as long as 24 hours or more), after which a second heat treatment at a lower temperature for another extended period of time (for example, about 8 hours) is used. By placing a casting into a furnace or related processing vessel and heating it to this second heat treatment condition, the casting becomes artificially aged, thereby hardening the metal and increasing its strength in less time than it takes for natural aging.

Despite this, there is a desire to develop a solution treatment cycle for aluminum alloys that avoids the aforementioned shortcomings. There is also a desire to maximize the dissolution of strengthening elements in the solution with less time and energy. There is also a desire to develop a solution treatment cycle that is applicable to various aluminum alloys made by various forging, casting, powder metallurgy or other manufacturing processes.

BRIEF SUMMARY OF THE INVENTION

These desires are met by the present invention, where in accordance with a first aspect of the present invention, a method of heat treating an aluminum alloy is disclosed. The method includes establishing a temperature profile inside a processing vessel between an alloy soaking temperature and liquidus temperature, then rapidly heating the alloy quickly to the soaking temperature in a first heating operation. It will be appreciated by those skilled in the art that in the present context, such rapid heating involves heating times considerably faster than those in conventional use. For example, such heating may be performed within a few minutes, depending on the mass and wall thickness of the aluminum object. This rapid heat-up, which may be about an order of magnitude faster than a conventional heat-up, helps break down a network of second-phase particles, due to high thermal tensile stresses induced in the particles, as well as speed up dissolution and spheroidization of the equilibrium phases. After that, the temperature inside of the processing vessel is reduced to the soaking temperature and then the alloy is heated to a temperature above the soaking temperature through a gradually increasing temperature in a second heating operation. In this way, the solution heat treatment, which is non-isothermal in that the imparted temperature profile is a function of time, can be tailored to the needs of the alloy, thereby optimizing its mechanical properties (for example, strength) with minimal energy input and cycle time.

Optionally, the method includes reducing the temperature inside the processing vessel gradually to soaking temperature in the first heating process right after the alloy is placed in the vessel. The method further comprises maintaining the alloy at a substantially constant soaking temperature between the first and second heating operations. The gradual heating of the second heating operation may be based on measured, sensed or predicted properties. For example, upon the dissolution rate of low melting point components of the alloy that are subsequently used to cause alloy age hardening. The progressive diffusion of the low melting point constituents in the alloy leads to a gradual increase in the melting point of the remaining materials based on the thermodynamics of phase equilibrium and thus the alloy can be gradually heated to a higher temperature without causing incipient melting. In one particular form, the processing vessel is a furnace, which may be a hot-air furnace or fluidized bed furnace. In addition, the method may involve a batch process or a continuous process. In yet another option, the method can be used to help minimize precipitate free zone (PFZ) size in subsequent aging treatment, which is good for increasing fatigue resistance. In addition, with computational thermodynamics and kinetics models, the non-isothermal solution treatment can be optimized. In a particular form, the time it takes to rapidly heat up the alloy in order to attain the desired soaking temperature is five or fewer minutes. Even more particularly, the time it takes under the claimed rapid heating is three or fewer minutes.

In accordance with a second aspect of the present invention, a method of determining a solution heat treatment protocol for an aluminum alloy is disclosed. The method includes developing a model to simulate a microstructural response of the aluminum alloy to a plurality of non-isothermal heat treating conditions, the model comprising at least one of computational thermodynamics and kinetics; and optimizing the protocol to maximize at least one mechanical property (for example, strength) of the alloy. With the use of self-consistent thermodynamic modeling techniques, thermodynamic descriptions of competitive phases including metastable phases can be developed for a complex multicomponent system during solution treatment. The inventor has discovered that this allows reasonable predictions in the change in competition between phases with changes in alloy composition and temperature. Such advances have also been noted in computational thermodynamics. The computational thermodynamics and kinetics approach can not only predict what happens at equilibrium but also provide guidance on what might happen at the nucleation, growth, or dissolution stage. This allows some degree of tailoring of the heat transfer process (such as solution treatment) to expedite the dissolution process of low melting phases in the alloy without causing incipient melting. The advent of computational thermodynamics also provides a great opportunity for coupling multi-scale structure modeling with phase equilibrium calculation for multicomponent systems.

In accordance with a third aspect of the present invention, a method of non-isothermally heat treating an aluminum alloy is disclosed. The method includes using at least one of a computational thermodynamics model and a kinetics model to establish a solution heat treatment protocol for the alloy, after which a temperature regime in accordance with the heat treatment protocol can be used to heat treat the alloy in a furnace or related processing vessel. The heat treatment protocol includes heating the processing vessel to a temperature between a soaking temperature and a liquidus temperature of the alloy that either has been or will be placed in the processing vessel. In addition, the protocol includes heating the alloy to the soaking temperature in a first heating operation, reducing the temperature inside of the processing vessel to the soaking temperature and heating the alloy to a temperature above the soaking temperature through a gradually increasing temperature in a second heating operation. In an optional form, a soaking temperature can be maintained for some time between the first and second heating operations.

BRIEF DESCRIPTION OF THE SEVERAL VIEWS OF THE DRAWINGS

The following detailed description of the present invention can be best understood when read in conjunction with the following figures.

DETAILED DESCRIPTION OF THE PREFERRED EMBODIMENTS

Figure 1A:
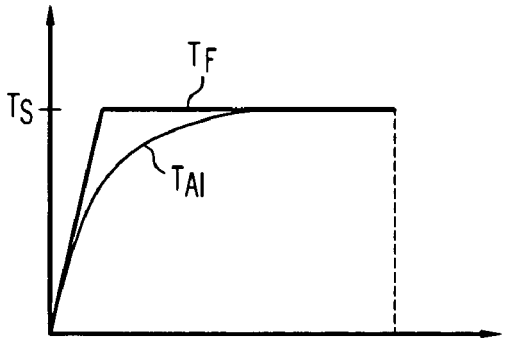
FIG. 1A (PRIOR ART)
FIG. 1A shows a typical solution heat treatment process according to the prior art for an aluminum alloy where a furnace and an aluminum alloy within the furnace are heated simultaneously to a soaking temperature.
Figure 1B:
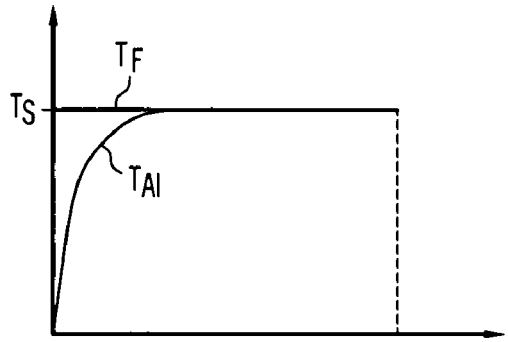
FIG. 1B (PRIOR ART)
FIG. 1B shows a typical solution heat treatment process according to the prior art for an aluminum alloy where a furnace is first heated to a soaking temperature after which an aluminum alloy within the furnace is brought up to the soaking temperature.
Figure 2:
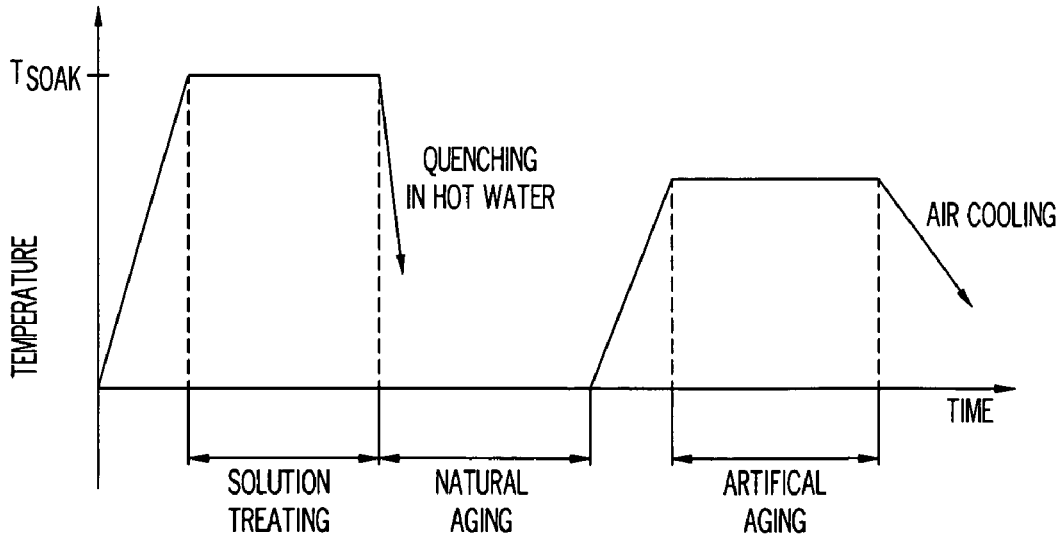
FIG. 2 (PRIOR ART)
FIG. 2 shows a typical T-6 heat treatment cycle according to the prior art for an aluminum alloy.
Figure 3A:
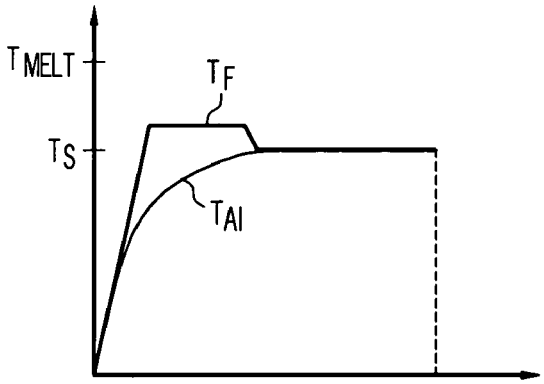
FIG. 3A shows a first heating operation of a non-isothermal solution treatment process according to an aspect of the present invention for batch processing.
Figure 3B:
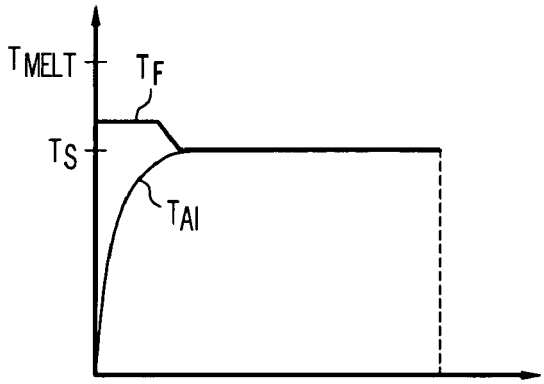
FIG. 3B shows a first heating operation of a non-isothermal solution treatment process according to an aspect of the present invention for continuous processing.

Referring initially to FIGS. 3A and 3B, rapid heating is used to attain an initial furnace or heating media temperature $T^i_F$ (also referred to as initial temperature profile) that is higher than a soaking temperature $T_S$ used in the traditional solution treatment. As shown with particularity in FIG. 3A, this can be used to simultaneously heat the furnace and the aluminum alloy contained therein in a batch process (where the temperature inside the furnace is brought up each time a new batch of aluminum alloy material is introduced), while as shown with particularity in FIG. 3B, it can also be used to establish an initial furnace temperature in a continuous process (where the temperature inside the furnace is always kept at an elevated level). Also as shown in both the batch and continuous processes, the soaking temperature is still lower than the melting point $T_M$ of the material. In the present context, the heating media may be sand, stainless steel or related media used in the fluidized bed. The initial temperature profile $T^i_F$ of the furnace or other heating media is designed based on computational thermodynamics and kinetics (both described in more detail below) to avoid any incipient melting. By temporarily keeping the initial temperature profile $T^i_F$ above the soaking temperature $T_S$, the aluminum alloy material (load) is heated much faster than through traditional heat treating. The initial temperature profile $T^i_F$ set-up can be also optimized to produce maximum thermal stress and the fastest fragmentation and spheroidization of equilibrium phases without causing any distortion and cracks in the materials. The fastest fragmentation and spheroidization of equilibrium phases will not only expedite the dissolution process but also reduce the macro/micro segregations resulting from the casting process. In many casting processes, the phase transformation process is not equilibrium.

It is practicable to set up an initial furnace or heating media temperature $T^i_F$ (also referred to as initial temperature profile) that is much higher than a soaking temperature $T_S$ used in the traditional solution treatment without causing incipient melting. In the initial heating stage, the temperature of the aluminum alloy object is low. According to heat transfer (Eqn 1), the heat flux transferred from the hot air to aluminum alloy object (the left side term in Eqn. 1) is much less than the heat flux conducted from the surface to the center of the aluminum alloy object (the right side term in Eqn. 1) because of the high thermal conductivity of aluminum alloy. Therefore, the $T_F(t)$ can be designed to maximize the heat-up rate by:

$$\mu(T_F^i - T_{AS}) << k(T_{AS} - T_{AC}) \quad (1)$$

where $\mu$ is the overall heat transfer coefficient from air to aluminum alloy object, k is the thermal conductivity of the aluminum alloy, $T_{AS}$ is the surface temperature of the aluminum alloy object and $T_{AC}$ is the temperature at the center of the aluminum alloy object.

As stated above, in aluminum alloys, solution heat treatment involves dissolution of intermetallics, spheroidization of second phase particles and reduction of microsegregation and fragmentation as part of a homogenization activity. One significant advantage of the present invention relative to that of the prior art is that it employs a non-isothermal heat treating regimen. The maximum feasible solution treatment temperature in aluminum alloys at a given time depends on the state of microstructure evolution and existence of phases of the materials. The upper limit of the solution treatment (soaking) temperature $T_S$ in the aluminum alloy object should not exceed the lowest melting point of the remaining phases in the alloy.

$$T_S < \mathrm{Min}\, T_{m(T,t,C)} \quad (2)$$

where $\Omega = \{0 < T < T_o;\ 0 < t < t_o;\ 0 < C < C_o\}$.

Figure 4A:
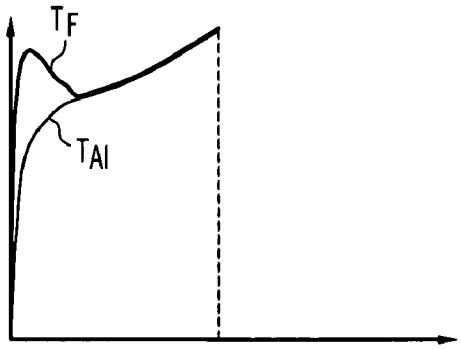
FIG. 4A shows both the first heating operation and a second heating operation of a non-isothermal solution treatment process according to an aspect of the present invention for batch processing.
Figure 4B:
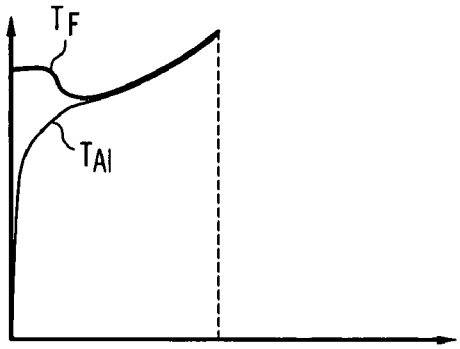
FIG. 4B shows both the first heating operation and a second heating operation of a non-isothermal solution treatment process according to an aspect of the present invention for continuous processing.

FIGS. 4A and 4B show the non-isothermal solution treatment temperature profiles proposed in this invention for both batch (FIG. 4A) and continuous (FIG. 4B) processing. The temperature profiles of both furnace $T_F$ and alloy being heat-treated $T_A$ are functions of time, and are calculated and optimized during the entire solution treatment based on computational thermodynamics and kinetics, the latter including dissolution/coarsening kinetics.

Figure 5:
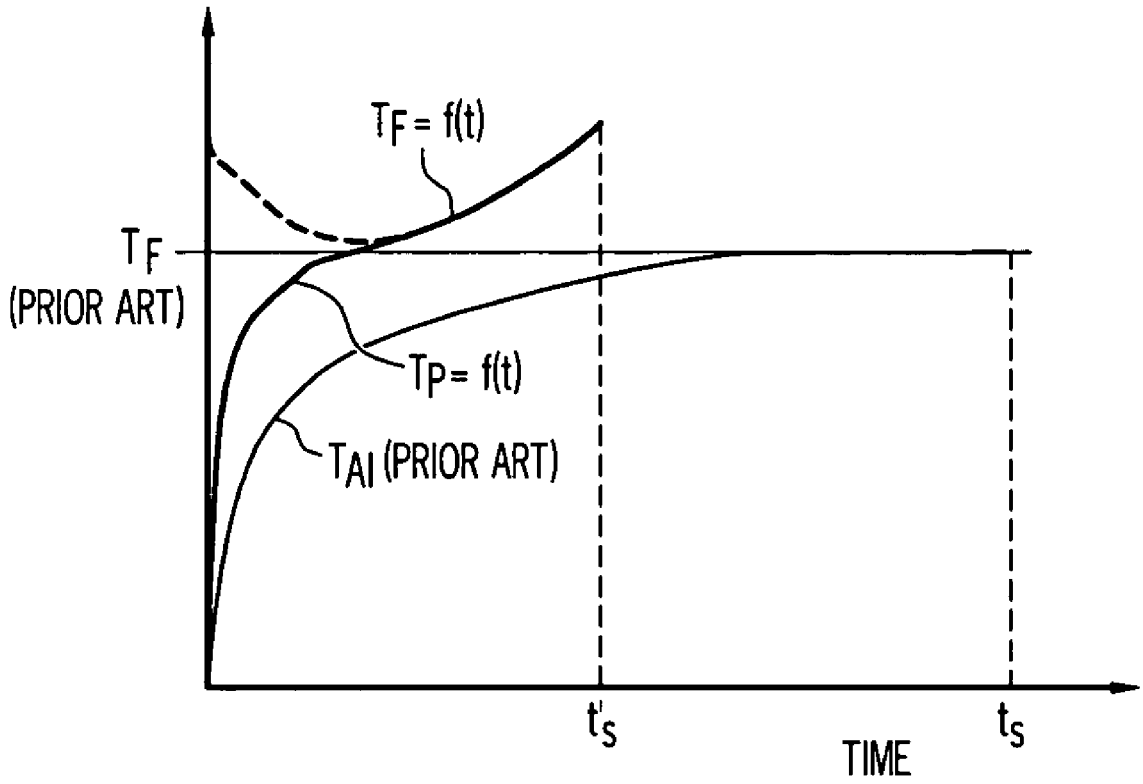
FIG. 5 shows a representative temperature profile of both a furnace and an aluminum alloy parts based on at least one of computational thermodynamics and dissolution or coarsening kinetics according to an aspect of the present invention superimposed on a representative profile of the prior art.
Figure 6:
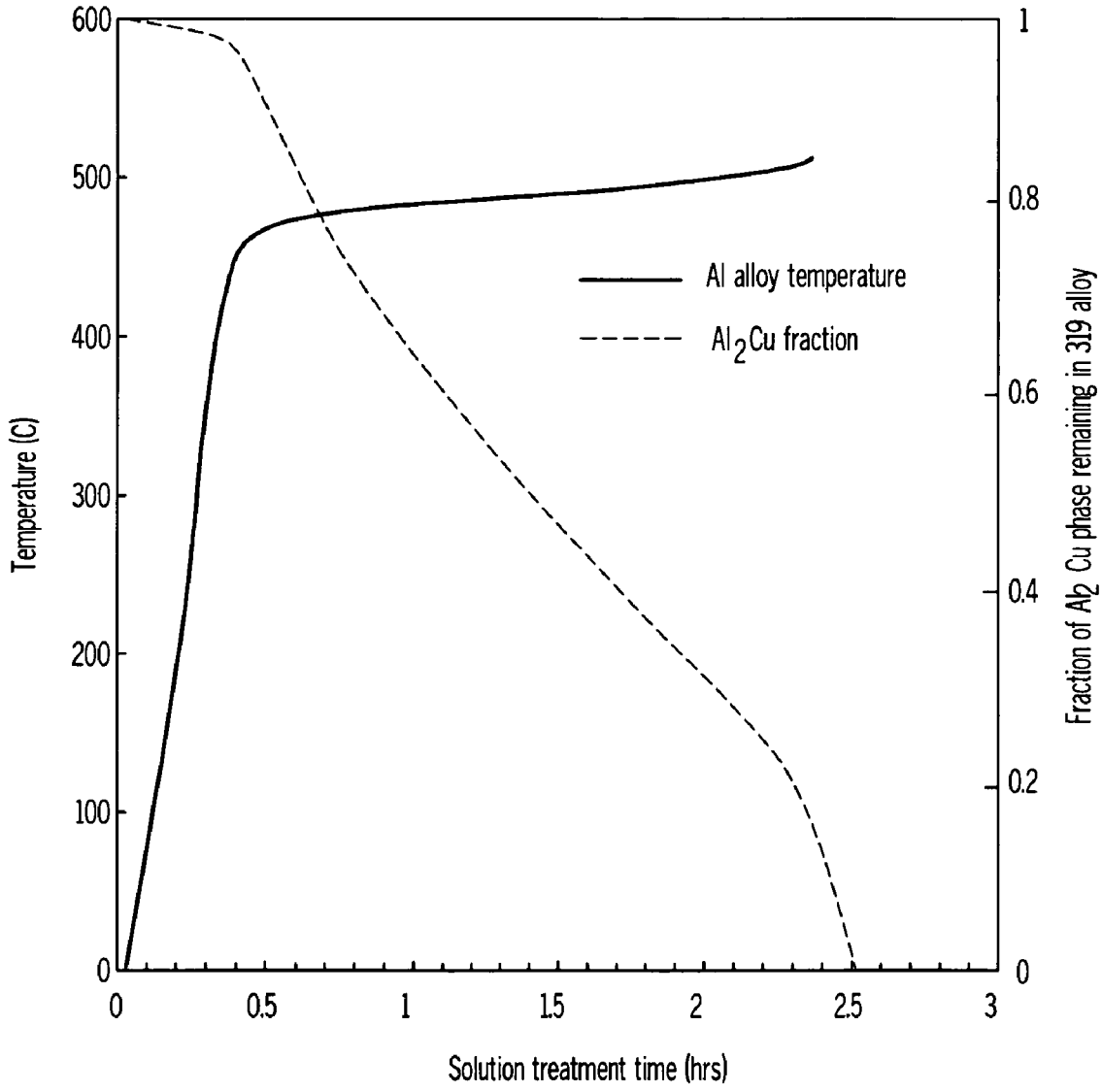
FIG. 6 shows the relationship between the fraction of a remaining $Al_2Cu$ phase in 319 aluminum alloy (SDAS: 40 μm) and a non-isothermal solution treatment cycle.

Referring next to FIGS. 5 and 6, the use of computational thermodynamics and various kinetics models are shown, where a non-isothermal solution heat treatment process according to an aspect of the present invention is composed of fast heat-up period to bring the temperature inside the processing vessel up to the initial temperature profile $T^i_F$, an optional short period for soaking that brings the temperature down to $T_S$, and a solution treatment period with a gradually increased temperature $T_F(t)$. As shown, the initial furnace temperature $T^i_F$ is initially set up above the soaking temperature $T_S$ (but below liquidus or melting temperature of the alloy, not shown) and then gradually dropped back to the soaking temperature $T_S$. At this time (shown as the low point in the furnace temperature curve), the alloy being heat-treated reaches the same temperature. The fast heat-up helps break down a network of second-phase particles, due to high thermal stresses induced in the particles, as well as speed up dissolution and spheroidization of the equilibrium phases. The thermal stresses, $\sigma_{th}$ induced in the particles can be estimated using:

$$\sigma_{th} = C\, E_P(\alpha_{Al} - \alpha_P)\Delta T_A d_P \quad (3)$$

where C is a constant, $E_P$ is the Young's modulus of second phase particles, $\alpha_{Al}$ and $\alpha_P$ are linear coefficients of expansion for the aluminum matrix ($23\times10^{-6}$/° C. at 20° C.) and second phase particles (such as Si particles, $3\times10^{-6}$/° C. at 20° C.), respectively. The expansion coefficients usually increase with temperature. $\Delta T_A$ represents the temperature increase in the aluminum alloy object at a given heat-up time period, which depends on the heat-up rate, while $d_P$ is the characteristic equivalent size of the second phase particles.

Given that the thermal expansion coefficient in the aluminum matrix is much greater than that for second phase particles such as silicon particles, the aluminum matrix will expand more than the second phase particles for the same $\Delta T$. To be compatible with the aluminum matrix expansion in an aluminum alloy object, tensile stresses are induced in the second phase particles. When the tensile stress is greater than the fracture strength of the second phase particles, the second phase particles will break down and thus fragmentation will take place.

In the first heat-up operation, the temperature profiles of the furnace $T_F(t)$ and aluminum alloy object $T_A(t)$ can be designed and further optimized according to the following Equation.

$$\nabla(\mu(T_F(t) - T_A(t)) = \frac{\partial(\rho C_p T_A(t))}{\partial t} \quad (4)$$

where μ is the overall heat transfer coefficient from air to aluminum alloy object, ρ is the density of aluminum alloy object, $C_p$ is the specific heat of aluminum alloy object.

When the aluminum alloy part temperature reaches the soak temperature $T_S$, the furnace can be gradually heated up to a higher temperature $T_F(t)$ commensurate with a particular solution heat treatment protocol. As described below, this protocol depends on the dissolution rate, which is diffusion-controlled, of low melting-point phases in the alloy interested. Thus, the temperature profiles of both the furnace (or related vessel) and aluminum alloy material can be either determined experimentally or calculated and optimized during the entire solution treatment based on computational thermodynamics and dissolution/coarsening kinetics.

As shown with particularity in FIG. 6, the temperature profile of aluminum alloy object (for instance 319 alloy) and the fraction (percentage) of remaining intermetallic phases (for instance $Al_2Cu$) during solution treatment are calculated based on computational thermodynamics and kinetics models, including dissolution kinetics and coarsening kinetics. During solution heat treatment, soluble constituents of the alloy may spherodize and coalesce, and some dissolve completely, depending on constituent composition and its melting temperature. Relatively insoluble constituents become less angular as corners of high energy dissolve, thereby reducing stress concentration levels in the alloy. Through the dissolution of soluble constituents, the supersaturation level of the solute elements in the alloy increases, providing an increased driving force for precipitation reactions during the subsequent aging treatment. In a 319 aluminum alloy, the intermetallic phase $Al_2Cu$ has a low melting temperature and it can dissolve completely at temperatures between 480 and 510 degrees Celsius for a certain period of time. The amount of time to completely dissolve the $Al_2Cu$ phase depends on the temperature and initial as-cast sizes of the $Al_2Cu$ particles. The higher the soaking temperature, the faster the intermetallic particles dissolve. Similarly, the smaller the $Al_2Cu$ particle sizes, the shorter the time needed to dissolve the particles. In general, the dissolution of the equilibrium second phase during solution heat treatment can be considered to be a diffusion-controlled process. For the dissolution of a spherical precipitate with a curvature of p, the rate of dissolution can be estimated by:

$$\frac{dr_i}{dt} = -\left(\frac{(C_i^d - C_i^g)D_i}{(C_i^p - C_i^d)r_i}\right) - \left(\frac{C_i^d - C_i^g}{C_i^p - C_i^d}\right)\left(\frac{D_i}{pt}\right)^{1/2} \quad (5)$$

where $r_i$ is the radius of the $i^{th}$ precipitate, $C_i^d$ is the equilibrium concentration of solute at the dissolution temperature, $C_i^g$ is the equilibrium concentration of solute at the growth temperature, $C_i^p$ is the concentration of solute in the $i^{th}$ precipitate, $D_i$ is the diffusivity, p is the curvature of the precipitate, and t is the time of dissolution.

Eqn. (5) requires knowledge of the concentration profile, which can use the following equation for multicomponent diffusion, namely $$\frac{\partial C_i(r, t)}{\partial T} = \nabla \cdot \Sigma Dij \nabla Cj(r, t) \quad (6)$$

where $C_i(r, t)$ is the concentration of the $i^{th}$ element at position r and time t, $C_j(r, t)$ is the concentration of the $j^{th}$ element at position r and time t, while $D_{ij}$ represents the diffusion coefficients of the solutes such as Mg, Cu in aluminum matrix. Equations (5) and (6) are solved through by means of iteration. Coarsening of second phase particles, such as Si, occurs either through Ostwald ripening or coalescence or through a combination of both mechanisms. Ostwald ripening involves mass transfer by the detachment of atoms from smaller structures, followed by diffusion of these atoms through the matrix to ultimately attach themselves to the surface of larger structures. The end result of ripening is shrinkage of the smaller structures and growth of the larger structures. The average particle size in the system increases while the number density of particles decreases. Coarsening, on the other hand, involves the merging of two or more particles. For this to occur the particles must be in contact with each other; and in this case, the driving force is the decrease in surface energy. The most frequently referenced description of coarsening is that due to Liftshitz-Sylozov-Wagner (LSW), namely $$r_{eq}^3 - r_o^3 = \frac{8}{9}\frac{DC_o\gamma V_{atom}^2 t}{RT} \quad (7)$$

where $r_{eq}$ is the radius of the coarsening precipitate and $r_o$ is its initial radius, D is the diffusivity, R is the universal gas constant, $C_o$ is the equilibrium concentration of the coarsening phase, T is temperature, γ is the surface energy, $V_{atom}$ is the atomic volume ($m^3$/mol), and t is the time of coarsening.

Figure 7:
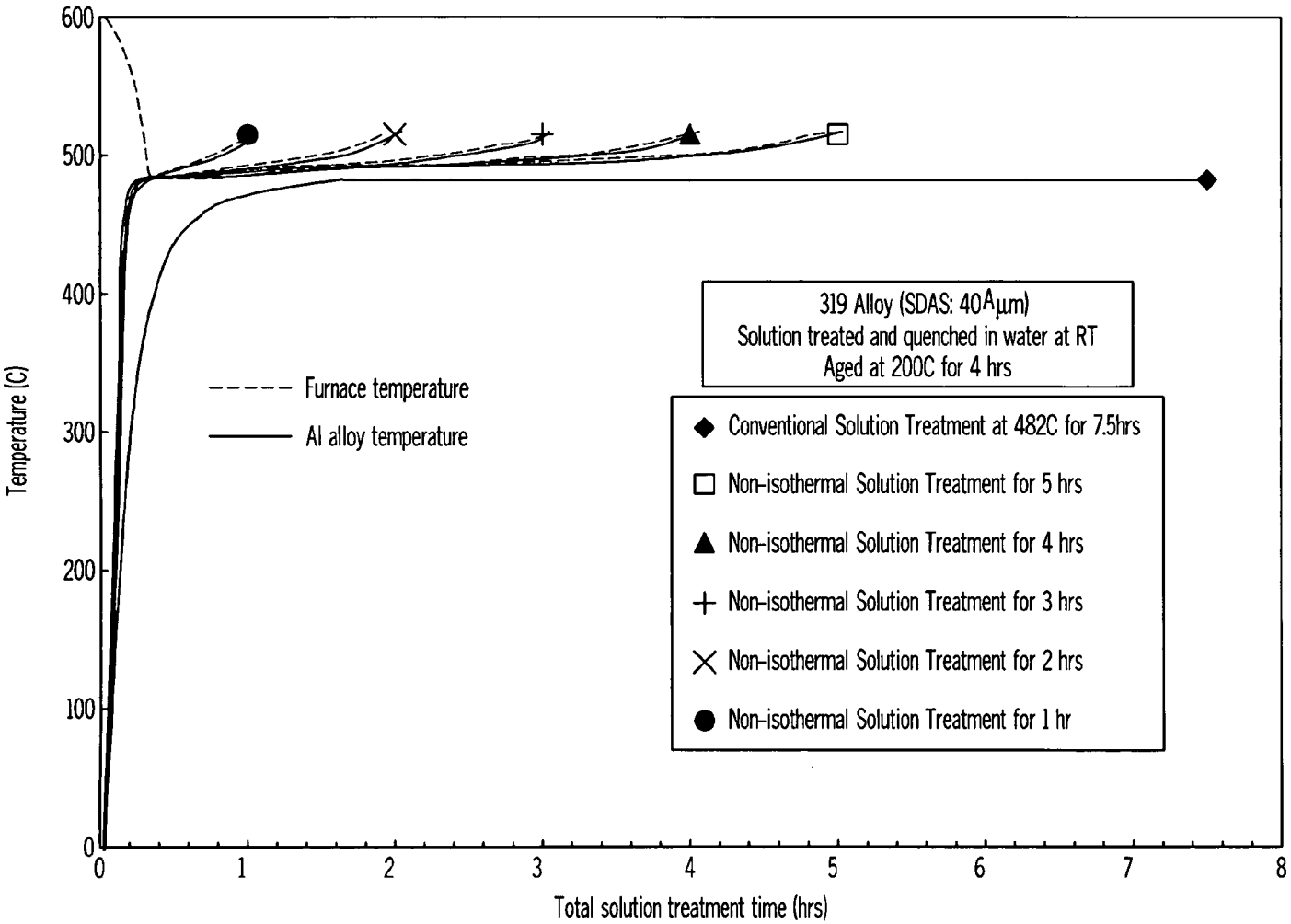
FIG. 7 shows the temperature profiles for both a hot air batch furnace and an aluminum alloy object in several non-isothermal solution treatment cycles and a conventional solution treatment.
Figure 8:
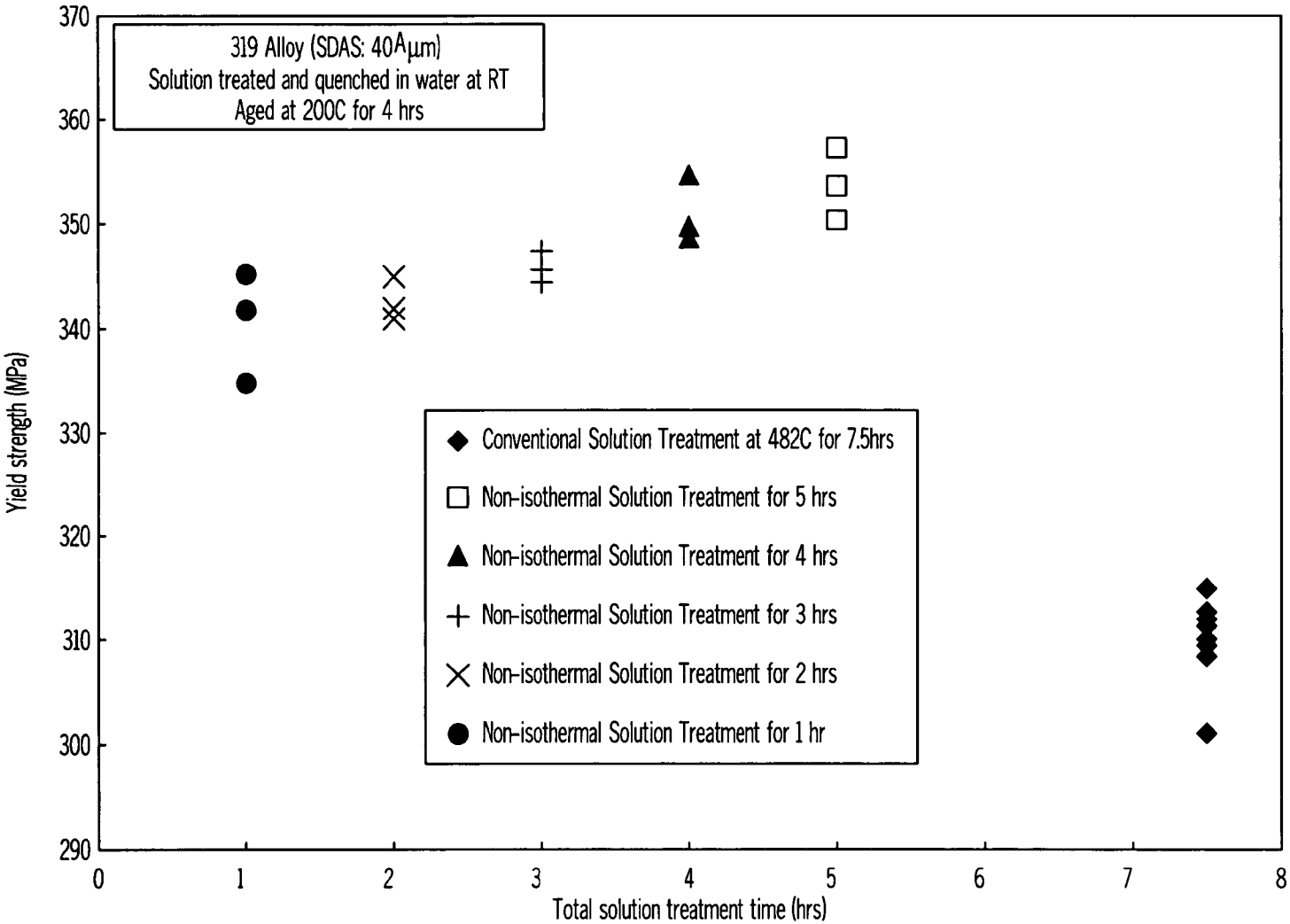
FIG. 8 shows the comparison of yield strengths at room temperature of 319 aluminum alloy that has been solution-treated in several non-isothermal solution treatment cycles and a conventional solution treatment.

FIGS. 7 and 8 show examples of several non-isothermal solution treatment cycles compared with a conventional isothermal solution treatment process in their thermal cycle difference and resultant tensile properties. As shown in the figures, all non-isothermal solution treatment cycles produce higher yield strengths in comparison with the conventional one. The yield strength is increased by 10-15% while the heat treatment cycle time is reduced by at least 35%.

Figure 9A:
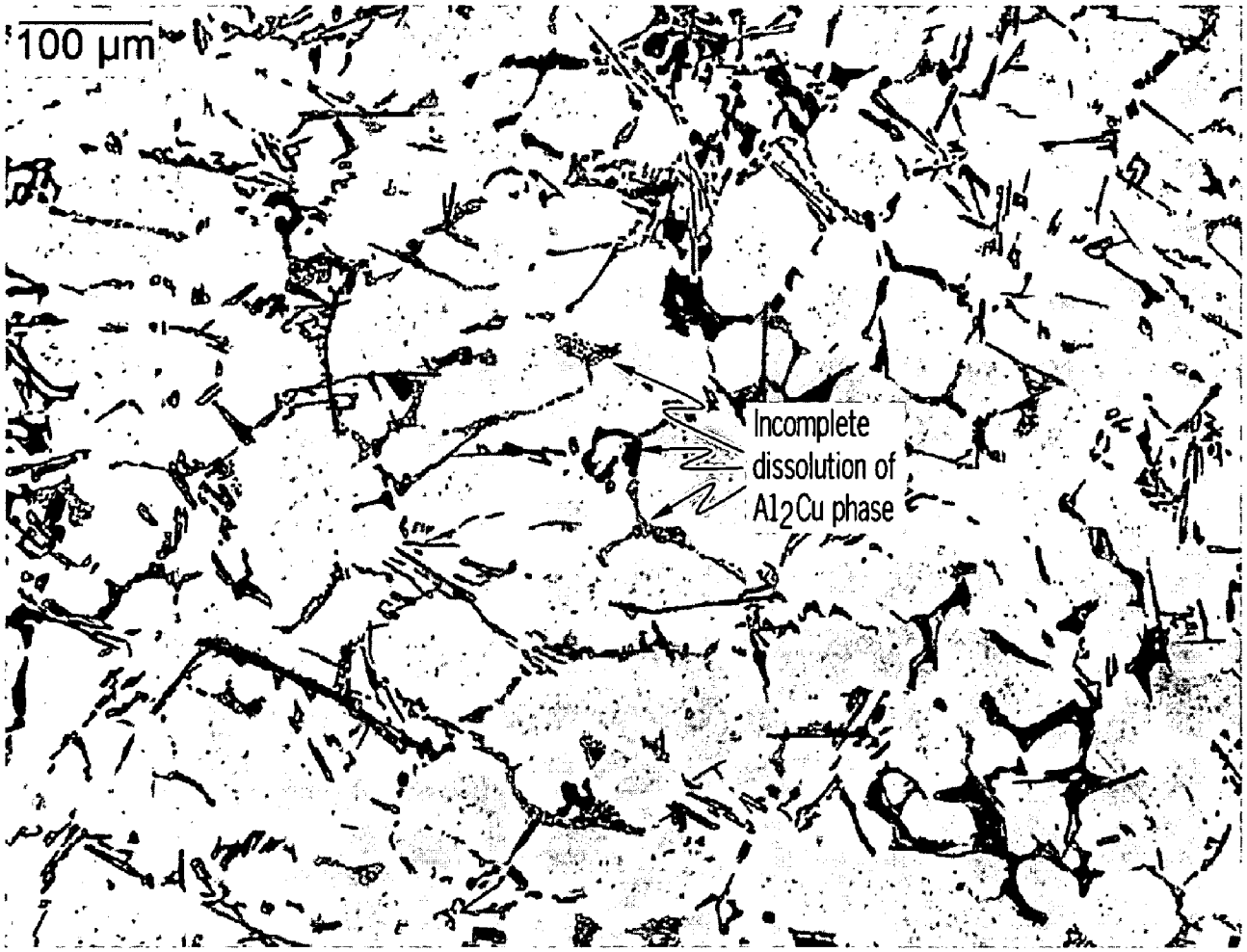
FIG. 9A shows a micrograph of the microstructure of a 319 aluminum alloy (SDAS: ~40 um) that has been solution-treated in a conventional process.
Figure 9B:
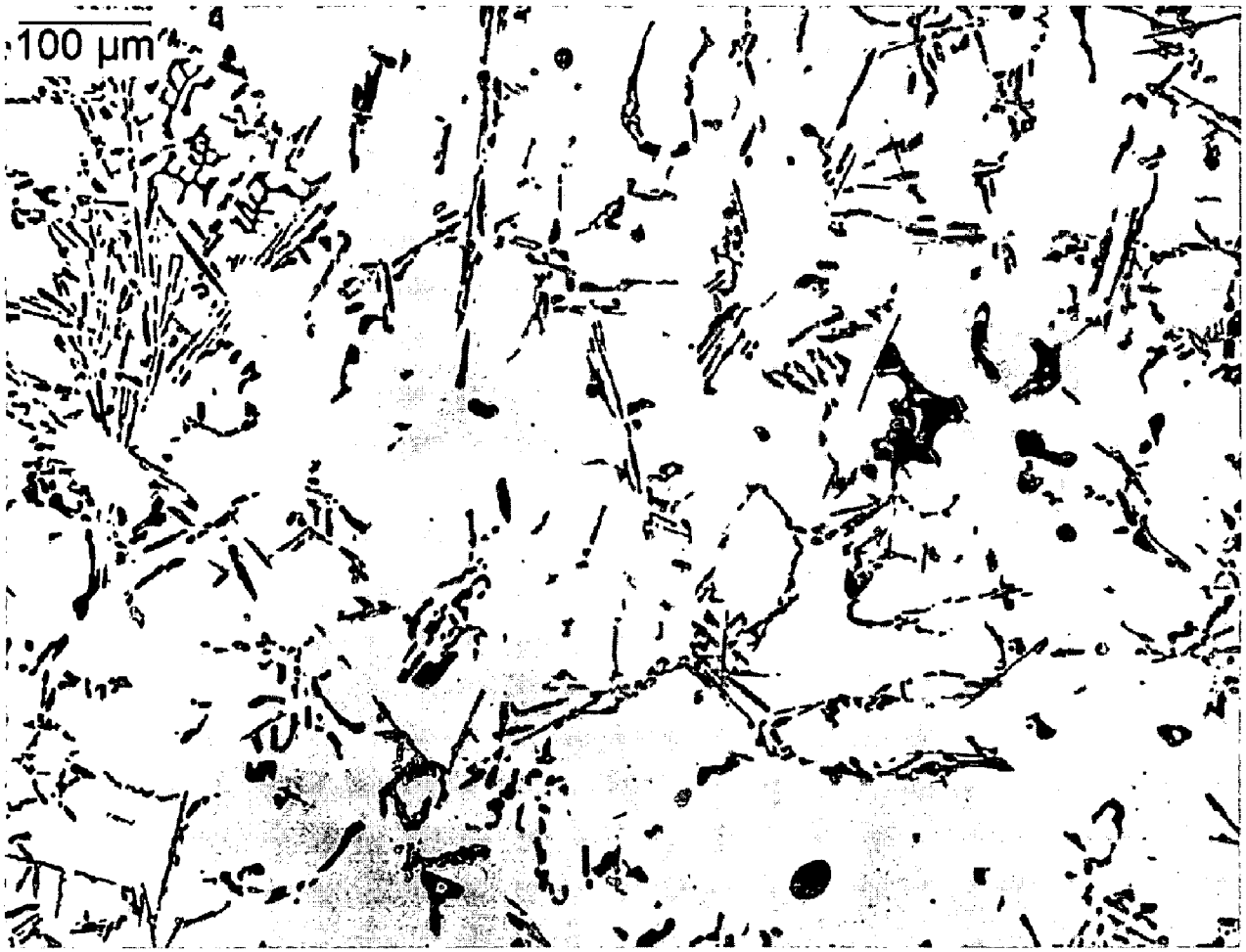
FIG. 9B shows a micrograph of the microstructure of a 319 aluminum alloy (SDAS: ~40 um) that has been solution-treated in a non-isothermal cycle using the temperature profile shown in FIG. 7.

As shown in the micrographs of FIGS. 9A and 9B, an incomplete dissolution of one constituent, $Al_2Cu$, is observed in a conventional solution heat treated microstructure of 319 aluminum alloy (FIG. 9A), while a complete dissolution of $Al_2Cu$ phase has been seen in the microstructure solution-treated in a non-isothermal cycle for 4 hours, as shown in FIG. 9B. The complete dissolution of the $Al_2Cu$ phase is attributed to the increase of yield strength. In addition, the edges of the silicon particles look blunter in the non-isothermal solution treated microstructure, although the solution treatment time is reduced almost in half.

The proposed accelerated solution heat treatment discussed herein can also help minimize PFZ size in subsequent aging treatment. This has the additional benefit of increasing fatigue resistance, as it avoids the tendency of prolonged heat treatments to coarsen eutectic silicon particles, which would result in a depletion of silicon at the periphery of the dendrites.

While certain representative embodiments and details have been shown for purposes of illustrating the invention, it will be apparent to those skilled in the art that various changes may be made without departing from the scope of the invention, which is defined in the appended claims.

What is claimed is:

1. A method of non-isothermal solution heat treating an aluminum alloy, said method comprising:

establishing a temperature inside a processing vessel between a soaking temperature and a liquidus temperature of said alloy;

rapidly heating said alloy to said soaking temperature in a first heating operation;

reducing said temperature inside of said processing vessel to said soaking temperature; and heating said alloy to a temperature above said soaking temperature through a gradually increasing temperature in a second heating operation, wherein non-isothermal heating occurring in said first and second heating operations is sufficient to provide solutionizing of said alloy.

2. The method of claim 1, wherein said method further comprises maintaining said alloy at a substantially constant soaking temperature between said first and second heating operations.

3. The method of claim 1, wherein said rapidly heating of said first heating operation is based on the thermal properties and heat transfer properties of said alloy.

4. The method of claim 1, wherein said gradual heating of said second heating operation is based upon a dissolution rate of low melting point phases or constituents of said alloy that are subsequently used to cause age hardening of said alloy.

5. The method of claim 1, wherein said processing vessel comprises at least one of a furnace and a heating device.

6. The method of claim 5, wherein said furnace comprises one of a hot-air furnace and a fluidized bed furnace.

7. The method of claim 5, wherein said heating device comprises at least one of an oil bath and a salt bath.

8. The method of claim 6, wherein said method comprises one of a batch process and a continuous process.

9. The method of claim 1, wherein a protocol for said second heating operation is based on at least one of a computational thermodynamics model and a kinetics model.

10. The method of claim 9, wherein said kinetics model comprises at least one of dissolution kinetics and coarsening kinetics.

11. The method of claim 10, wherein said dissolution kinetics uses the equations $$\frac{dr_i}{dt} = -\left(\frac{(C_i^d - C_i^g)D_i}{(C_i^p - C_i^d)r_i}\right) - \left(\frac{C_i^d - C_i^g}{C_i^p - C_i^d}\right)\left(\frac{D_i}{pt}\right)^{1/2} \text{ and } \frac{\partial C_i(r,t)}{\partial T} = \nabla \cdot \Sigma Dij \nabla Cj(r,t),$$

where $r_i$ is a radius of an $i^{th}$ precipitate before dissolution, $C_i^d$ is an equilibrium concentration of solute at a dissolution temperature, $C_i^g$ is an equilibrium concentration of solute at a growth temperature, $C_i^p$ is a concentration of solute in the $i^{th}$ element, $D_i$ is a diffusivity of $i^{th}$ precipitate, p is the curvature of the precipitate, t is the time of dissolution, $C_i$ (r, t) is the concentration of an $i^{th}$ element at position r and time t, $C_j$ (r, t) is the concentration of an $j^{th}$ element at position r and time t, while $D_{ij}$ represents diffusion coefficients of solutes in said alloy, and T is temperature.

12. The method of claim 10, wherein said coarsening kinetics uses the equation $$r_{eq}^3 - r_o^3 = \frac{8}{9}\frac{DC_o\gamma V_{atom}^2 t}{RT},$$

where R is the universal gas constant, $C_o$ is an equilibrium concentration of said coarsening precipitate, $r_{eq}$ is a radius of coarsening precipitate, $r_o$ is an initial radius of said coarsening precipitate, T is temperature, γ is surface energy, $V_{atom}$ is atomic volume, and D is the diffusivity of said coarsening precipitate.

13. The method of claim 11, wherein said diffusion coefficients of solutes comprise at least one of magnesium and copper.

14. The method of claim 1, wherein said rapidly heating said alloy comprises achieving said soaking temperature in five or fewer minutes.

15. The method of claim 14, wherein said achieving said soaking temperature in five or fewer minutes comprises achieving said soaking temperature in three or fewer minutes.

16. A method of non-isothermally heat treating an aluminum alloy, said method comprising:

using at least one of a computational thermodynamics model and a kinetics model to establish a solution heat treatment protocol for said alloy; and controlling a temperature regime within a heating processing vessel in accordance with said heat treatment protocol, said heat treatment protocol comprising:

heating said processing vessel to a temperature between a soaking temperature and a liquidus temperature of said alloy that has been or will be placed in said processing vessel;

rapidly heating said alloy to said soaking temperature in a first heating operation;

reducing said temperature inside of said processing vessel to said soaking temperature; and heating said alloy to a temperature above said soaking temperature through a gradually increasing temperature in a second heating operation, wherein non-isothermal heating occurring in said first and second heating operations is sufficient to provide solutionizing of said alloy.

17. The method of claim 16, wherein said rapidly heating said alloy comprises achieving said soaking temperature in five or fewer minutes.

* * * * *